United States Patent [19]

Weidenaar et al.

[11] 3,995,670

[45] Dec. 7, 1976

[54] LIQUID-DISPENSING NOZZLE ASSEMBLY

[75] Inventors: Bernard E. Weidenaar, Hacienda Heights, Calif.; Frederick L. Voelz, Orland Park; James J. Simnick, Riverdale, both of Ill.; Peter P. Moskovich, Jr., Gary, Ind.

[73] Assignee: Atlantic Richfield Company, Philadelphia, Pa.

[22] Filed: May 22, 1975

[21] Appl. No.: 580,118

Related U.S. Application Data

[63] Continuation-in-part of Ser. No. 468,787, May 9, 1974, abandoned.

[52] U.S. Cl. ..... 141/392

[51] Int. Cl.[2] ..... B65B 3/04

[58] Field of Search ..... 141/39–44, 141/52, 47, 59, DIG. 1, 310, 290, 382–384, 387, 388, 390, 392; 285/263, 272; 222/188

[56] References Cited

UNITED STATES PATENTS

| | | | |
|---|---|---|---|
| 2,528,696 | 11/1950 | Logan et al. | 141/382 X |
| 2,850,049 | 9/1958 | Lomax | 141/310 X |
| 2,908,299 | 10/1959 | Gosselin | 141/290 X |
| 3,165,339 | 1/1965 | Faccou | 285/263 |
| 3,566,928 | 3/1971 | Hansel | 141/392 X |
| 3,581,782 | 6/1971 | Qnuter | 141/59 |
| 3,739,988 | 6/1973 | Kisor et al. | 141/392 X |
| 3,840,055 | 10/1974 | Wortl et al. | 141/44 |

*Primary Examiner*—Houston S. Bell, Jr.
*Attorney, Agent, or Firm*—Thomas J. Clough

[57] ABSTRACT

An improved liquid-dispensing nozzle and more specifically, an improved vapor recovery means for a nozzle comprising a vapor collector (such as a flexible bellows) surrounding a portion of the discharge spout in spaced relation thereto, one end of which is sealed to the upper portion of the nozzle spout and/or housing; and at the other end of the vapor collector, a compressible cellular plastic material such as foamed plastic associated therewith. When the discharge spout is inserted into, e.g., an automobile fillpipe, the compressible cellular plastic material forms a vapor seal with the upper end of the fillpipe whereby the vapors escaping from the fillpipe are directed into the interior chamber formed between the exterior of the discharge spout and the inside of the vapor collector thereby minimizing the escape of vapors to the atmosphere. The vapors are then removed from this chamber.

20 Claims, 2 Drawing Figures

LIQUID-DISPENSING NOZZLE ASSEMBLY

This application is a continuation-in-part of application Ser. No, 468,787, filed May 9, 1974, now abandoned.

The present invention relates to a nozzle for dispensing a liquid, and more particularly to a nozzle having means for preventing the escape of vapors during a liquid dispensing operation.

Normally, as a fuel such as gasoline is being supplied through a fuel-dispensing nozzle to, for example, an automobile fuel tank, fuel vapor escapes from the fuel tank fillpipe, this vapor of course adding to the already pressing air pollution problem. Such air pollution is increasingly becoming a cause of concern and numerous governmental jurisdictions are requiring control of causes of air pollution. An increasing number of jurisdictions are requiring minimization of escape of both liquid fuel and fuel vapor from vehicles which are being supplied with fuel. Reducing the fuel delivery rate, while reducing liquid-splash-back, does not prevent escape of vapors and in fact, because of the longer time required to fill the vehicle fuel tank, may increase the escape of fuel vapors lost during the filling of the tank.

The prior art has suggested various means of recovering vapors which otherwise would escape to the atmosphere while fuel tanks are being filled. For example, U.S. Pat. No. 3,581,782 discloses a vapor emission control system suitable for gasoline and other fuel delivery sytems, and adapted to eliminate the escape of fuel vapors to the atmosphere. The disclosed embodiment of the control system includes, for example, a flexible annular sleeve surrounding the spout of the nozzle and sealed to the fillpipe of the fuel tank by means of an expandible member which, when expanded after the spout is inserted into the fillpipe, prevents the emission of vapor to the atmosphere.

Similarly, U.S. Pat. No. 3,566,928 discloses a vapor seal for fuel dispensing nozzles wherein the forward end (i.e., the end opposite the main housing of the nozzle) of the flexible bellows which surrounds the spout is sealed to the fillpipe by means of an annular-shaped magnetic rubber sealing assembly.

It is known also in the prior art simply to employ a flexible means surrounding the spout, such as the flexible bellows by itself. In this case, when the discharge spout is inserted into the fillpipe, the flexible bellows is compressed and tends to seal itself to the upper portion of the fillpipe. However, this seal between the forward or heel portion of the bellows and the upper portion of the fillpipe is not a good one, and hence the above-noted prior art suggestion for using magnetic rubber means.

Reference is also made to U.S. Pat. Nos. 2,850,049 and 2,908,299 for fuel vapor recovery systems.

There is therefore a need for a simple and effective device for sealing a vapor collection device to the upper portion of, for example, an automobile fillpipe. Specifically, there is a need for improving the seal that is possible between, for example, the flexible bellows of the prior art and the upper portion of an automobile fuel tank fillpipe.

It is therefore a primary object of the present invention to provide a liquid-dispensing nozzle provided with vapor recovery means.

It is a further object of the present invention to provide a liquid fuel-dispensing nozzle wherein the seal between the vapor collecting means and the automobile fuel tank fillpipe is improved.

It is yet a further object of the present invention to provide such an improved sealing means which is simple in design.

Other objects and advantages will become apparent to those skilled in the art from the ensuing description.

The present invention accomplishes the above objects and others by utilizing, in conjunction with a vapor collector means (such as flexible bellows) which surround a portion of the discharge spout of a liquid fuel-dispensing nozzle, a compressible cellular plastic material such as foamed plastic affixed to, mounted on, and/or carried by the forward or heel portion thereof to engage the upper portion of, for example, the automobile fuel tank fillpipe. The use of the compressible cellular plastic material provides a greatly improved seal between the vapor collector means, preferably a flexible bellows, and the fillpipe compared to the use of the vapor collector alone.

The improved vapor recovery apparatus of the present invention is particularly useful with conventional liquid fuel-dispensing nozzles, and while the present invention is applicable to all liquid-dispensing nozzles, it is particularly useful with liquid fuel (e.g., gasoline) nozzles, and the present invention will therefore be described with reference to the latter, although those skilled in the art will realize that the invention generally is applicable to a much broader field.

A liquid fuel-dispensing nozzle comprises a main body or housing having an integral handle, a fuel inlet which normally comprises a flexible conduit means communicating between the source of fuel such as an undergroud storage tank, and a discharge spout which is adapted for insertion into the fillpipe of the fuel tank. A latching means, such as a spring means, is usually provided on the discharge spout. The spring means, for example provided around a major portion of the discharge spout, assists in latching the spout in the fillpipe during the filling operation, especially during self-serve operations.

As pointed out above, the prior art has suggested that a vapor collecting device, such as a flexible bellows, be employed to surround a major portion of the discharge spout. The bellows is sealed to the housing at the upper end of the spout or to the housing itself and terminates in a heel-portion which is annular in shape and has a flat face for contacting the upper portion of the fillpipe. As the spout is inserted into the fillpipe, the bellows is compressed and the flat face of the heel portion forms a seal with the upper portion of the fillpipe.

According to the present invention, a compressible cellular plastic material, such as a foamed synthetic resin cellular plastic, is carried by or secured to the vapor collector, such as the flat-faced heel portion of the bellows and it is this compressible cellular plastic material which contacts the fillpipe. It has been found that such material greatly improves the seal between the flexible bellows and the fillpipe and improves the reduction in the amount of vapors escaping to the atmosphere. Suitable means is provided for removing the vapors from the interior of the bellows, as is conventional.

Figure 1:
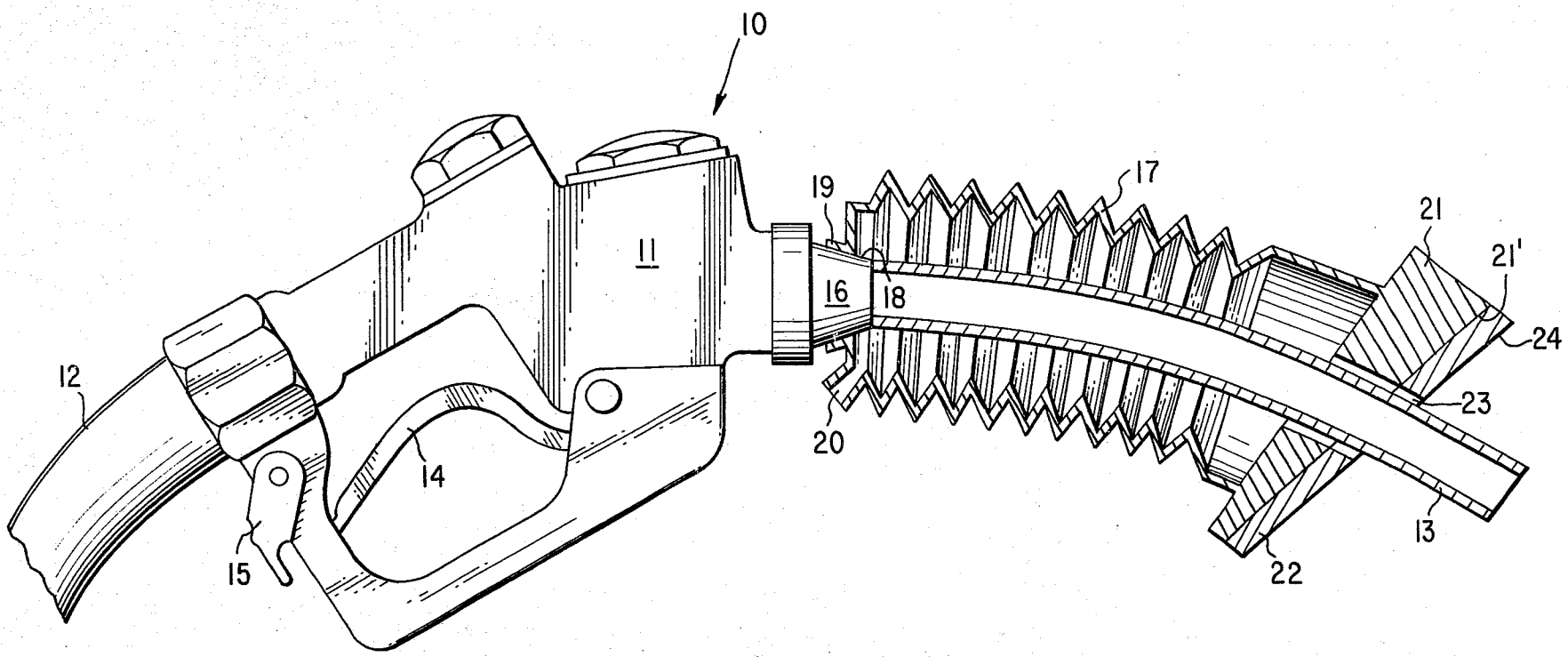
FIG. 1 is a side view, partly in cross-section, of the improved fuel-dispensing nozzle of the present invention.

Referring now to FIG. 1, a typical gasoline-dispensing nozzle is shown which is provided with vapor recovery means. More specifically, a nozzle generally designated 10 comprises a main body or housing 11, an inlet conduit 12 and a discharge spout 13. A handle 14 is provided for actuating the delivery of gasoline or other liquid fuel. In addition, and as is conventional, a retainer means 15 is also provided on the main body of the housing for holding the handle 14 in its fuel-delivery position. It is also conventional to provide such nozzles with means for automatically shutting off delivery of fuel when the fuel tank or fillpipe is full. Such means are not shown in FIG. 1, but may includes an orifice near the discharge outlet of the spout 13, and a tube communicating from the orifice to a control mechanism within the main body 11 of the nozzle, wherein the control mechanism, sensing the presence of a gas or liquid near the orifice, acts to disengage handle 14 from retainer 15 thereby automatically stopping delivery of fuel through the nozzle.

The major portion of spout 13 is surrounded by a flexible vapor collector which may take the form of a flexible bellows 17. The upper end 19 of bellows 17 is sealed to surface 18 of tapered portion 16 of the nozzle. The opposite end of bellows 17 comprises a heel portion 21 having a flat face 21' and, according to the present invention, a compressible cellular plastic material 22 is carried by or secured to face 21' of heel portion 21. Both heel portion 21 and compressible cellular plastic material 22 are subtantially annular in shape providing a space 23 between the same and the outside surface of spout 13, allowing vapors escaping from the fillpipe to pass therebetween and into the interior of bellows 17. An aperture 20 is conveniently provided near the upper end of the bellows 17 for removal of vapors. The means for removing the vapor from aperture 20 is not per se included within the scope of the present invention, but may comprise, for example, a flexible tubing attached to aperture 20, the flexible tubing communicating with, for example, a combustion means whereby the vapors may be rendered harmless. Alternatively, the hydrocarbons in the vapors may be recovered by other suitable means such as by absorption, condensation, or direct displacement to a fuel storage tank, such as an underground storage tank. Optionally, as is also conventional, means for directing these displaced vapors may be provided integrally with the body housing. It is also contemplated within the scope of this invention that the nozzle and/or vapor removal system can include a check valve which prevents vapor from other vapor recovery nozzles from being displaced through the vapor recovery nozzle in question when such nozzle is not in use.

Figure 2:
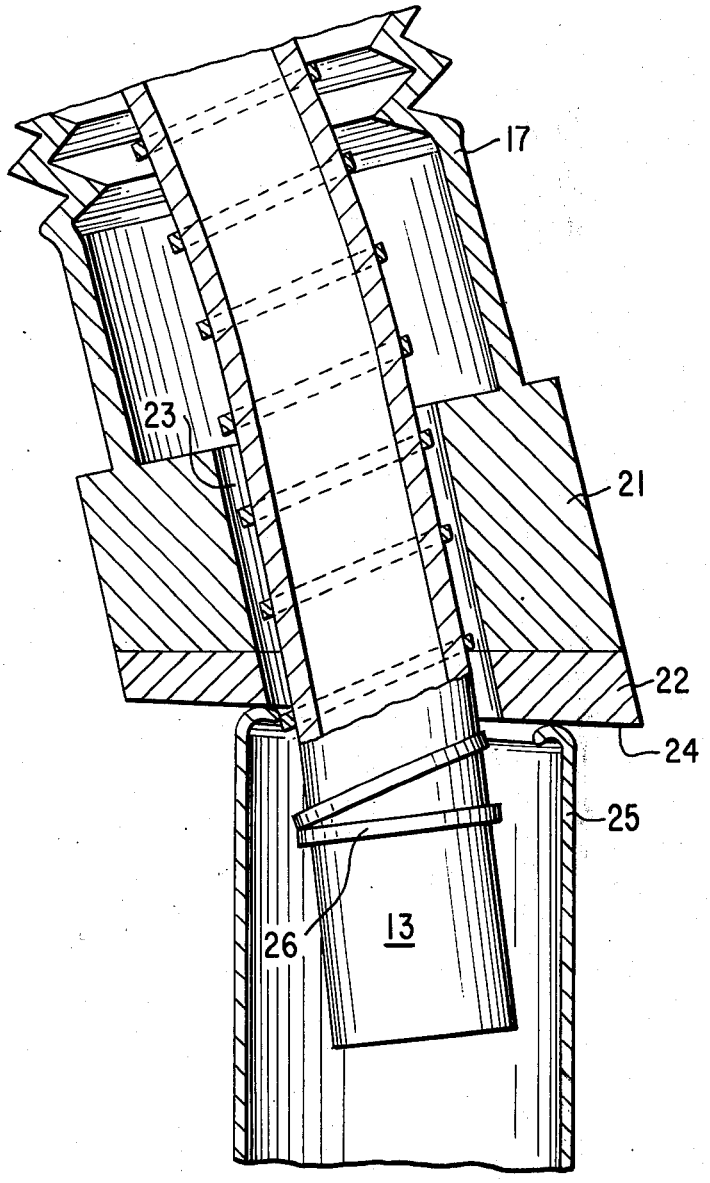
FIG. 2 is an enlarged view, partly in cross-section, of the improved liquid fuel-dispensing nozzle of the present invention inserted into a fillpipe of an automobile fuel tank.

Face 24 of compressible cellular plastic material 22 is the surface which contacts the fillpipe, reference now being made to FIG. 2 which shows the nozzle of the present invention inserted into a fillpipe. More specifically, referring to FIG. 2, spout 13 is shown inserted into a fillpipe 25, the upper portion of the latter contacting face 24 of compressible cellular plastic material 22 thereby sealing the same against vapor escape. The spout 13 is shown as being provided with a spring means 26 which assists in maintaining or latching the spout in the fillpipe during the filling operation. The spring 26 is preferably of square cross-section although a round spring is satisfactory. Other latching means can also be incorporated on the nozzle such as the spout to provide latching of the nozzles to the receiver inlet, i.e., fillpipe, during the dispensing of fuel. In operation, as the spout is inserted into the fillpipe, the spring means acts to retain the same therein. As the spout 13 is forced into the fillpipe, the bellows 17 is compressed and as the spout is held therein by means of the spring 26, face 24 of compressible cellular plastic material 22 tightly seals the fillpipe against possible vapor loss. Vapors which leave fillpipe 25 pass through space 23 into the interior of bellows 17 from which they are removed through aperture 20 (see FIG. 1).

The compressible cellular plastic material may be secured to or carried by the heel portion 21 of the bellows by any suitable means, for example, an epoxy-type cement or other adhesive means can be employed for this purpose, but those skilled in the art will realize that other means may be employed for this purpose. Of course, the flexible bellows and compressible cellular plastic material must be formed of materials which are substantially resistant to the fuel liquid and vapor being dispensed. For example, the bellows may be comprised of a flexible polychloroprene rubber (i.e., neoprene), such bellows being commercially available.

The compressible cellular plastic material is defined as a cellular plastic whose apparent density is decreased substantially by the presence of numerous cells disposed throughout its mass. Cellular plastic materials include two phase gas—solid systems in which the solid phase is a synthetic plastic and continuous, which term includes cellular rubbers and latexes.

The gas phase in the cellular plastic is usually distributed in voids or pockets called cells. These cells may be interconnected in a manner such that gas may pass from one to another, in which case this material is termed "open-celled". If the cells are discrete and the gas phase of each is predominately independent of that of the other cells the material is termed "closed-celled". It is preferred that the cells in the cellular material be substantially closed-celled, i.e., a predominate proportion being non-interconnecting cells.

The cellular plastic material can be defined by the amount of force (psi) required to obtain a 25% deflection of its original thickness, i.e., compression deflection test. In general, it is preferred that the cellular plastic material have a 25% deflection of from about 1 to about 50 psi; more preferably from about 5 to about 20 psi.

As has been set forth above, the compressible cellular plastic material includes cellular rubber and latex foam rubber. The cellular rubber, sometimes referred to as sponge rubber, includes those cellular rubbers produced by expanding rubber stocks and include both open-celled and closed-celled material. Latex foam rubbers are produced generally by frothing a rubber latex, chilling the frothed latex and then vulcanizing it in an expanded state.

The cellular plastic material may be prepared by a variety of methods. The most important process, by far, consists of expanding a fluid plastic phase to a low-density cellular state and then preserving this state. This has been termed a "foaming" or "expanding" process. The expansion process may be divided into three steps: creating small discontinuities or cells in a fluid or plastic phase, causing these cells to grow to a desired volume, and stabilizing this cellular structure by physical or chemical means.

The compressible cellular plastic is defined as a cellular plastic material which is compressible under a normal load (in psi) obtained when the compressible cellular plastic contacts the fillpipe during the dispensing of fuel. The term "compressible" is used in its normal dictionary sense and includes materials which deform to a certain extent when the spout of the nozzle is inserted into the fillpipe, thereby providing an extremely good seal against vapor escape. Typically, the compressible cellular plastic material is compressed under such normal load in the range of from about 5 to about 85%, more preferably from about 15 to about 70% and still more preferably from about 25 to about 70% based upon the original volume of material. Typical examples of the compressible cellular plastic material are the cellular materials obtained from polychloroprene, for example a latex, polyethylene, silicone rubber, urethane polymer, poly (vinyl chloride), including inter polymers thereof, such as polyvinylchloride nitrile polymers, polytetrafluoroethylene, cellulose acetopropianate, and urea-formaldehyde resin. Particularly preferred compressible cellular plastic materials are polyurethane foam and polychloroprene latex foam. As stated above, such compressible cellular plastic material should be substantially resistant towards the fuel liquid being dispensed and the corresponding vapor, particularly when such fuel is gasoline.

The exposed face of the compressible cellular plastic material can comprise an additional substantially non-cellular resilient material. This exposed face, such as a coating or surface material, either of the same or different chemical composition, as the cellular material, has to be resilient, that is, the material should deform to a certain extent when the spout of the nozzle is inserted into the fillpipe and the face makes contact with the fillpipe. For example, the exposed face of the compressible cellular plastic material can be coated with or have a surface skin of, the same plastic material used to form the cellular plastic material. Thus, the face can have a surface skin or coating which contacts the receiver inlet to which liquid is being dispensed. In addition, the face of the compressible cellular plastic material can comprise a surface skin or coating which is of a different material such as a synthetic resinous material or a natural occurring material, both of which are substantially resistant to fuel liquid and vapor being dispensed. Typical examples of resilient material are leather and synthetic resin such as polychloroprene (neoprene). It is contemplated within the scope of this invention that the term "compressible cellular plastic material" includes an exposed face comprising an additional substantially non-cellular resilient material carried by or affixed to the cellular plastic of the surface seal.

The thickness of the compressible cellular plastic material is not critical, and may vary from a minimum thickness required to provide the minimum seal to a maximum thickness which would be dictated by economic considerations (i.e., an extremely thick material would not be required). Typically, the compressible cellular plastic material is utilized in a thickness which may range from about 1/16 inch to about ½ inch.

The invention can be better appreciated by the following non-limiting examples:

EXAMPLE I

An OPW No. 7 vapor recovery gasoline dispensing nozzle was equipped with a polychloroprene bellows boot, one end of which was attached to the nozzle housing, the other end surrounding the nozzle outlet having only an exposed plain surface. The bellows boot was substantially of the same geometrical configuration as the boot set forth in FIG. 1. The second nozzle, as above, was equipped with an identical bellows boot except that the face contained a closed cell polychloroprene foam of approximately ¼ inch thickness. The cars were tested for percent hydrocarbon recovery at ambient conditions of temperature. The following table lists the percent hydrocarbon recovery utilizing the above nozzles.

TABLE I

| Type of Nozzle | No. of Cars Tested | % Hydrocarbon Recovery |
|---|---|---|
| OPW No. 7 Resilient Neoprene Plain Face (Non-cellular) | 86 | 65% [1] |
| OPW No. 7 Foam Face | 150 | 82% [2] |

[1] A round cross-section retention spring was used for maintaining the dispensing nozzle in position.
[2] A square cross-section retention spring was used for maintaining the dispensing nozzle in position.

EXAMPLE II

A modified OPW No. 7 vapor recovery nozzle was equipped with a polychloroprene bellows boot one end of which was attached to the nozzle housing, the other end surrounding the nozzle outlet having a surface face. The modification of the nozzle was the inclusion of a ¾ inch vapor return line on the bottom of the handle area. A square cross-section retention spring was used on the spout. The bellows boot was substantially the same geometrical configuration as the boot set forth in FIG. 1. The surface of the first boot was modified by affixing a unidirectional magnet to the boot surface. The magnet was further modified by the bonding of an outer leather surface to the magnet.

A second boot was modified the same as the first boot except that a closed cell urethane foam having a thickness of ⅛ inch was affixed to the unidirectional magnet. The leather surface was then affixed to the closed cell urethane foam.

The above gasoline nozzles were evaluated in a typical service station environment at ambient temperatures. Table II lists the results obtained from the evaluation of these gasoline nozzles.

TABLE II

| Type of Nozzle | No. of Cars Tested | % Hydrocarbon Recovery |
|---|---|---|
| OPW No. 7 + magnet + leather | 12 | 92.2% |
| OPW No. 7 + magnet + urethane foam + leather | 13 | 97.6% |

EXAMPLE III

A comparison was made between a fuel dispensing nozzle having a resilient neoprene plain material (non-cellular) as the sealant and a fuel dispensing nozzle having a compressible cellular neoprene material as the sealant. The nozzles were evaluated on random vehicles and the leaks found during the fueling of said vehicles are reported in Table III. The leaks were detected by a Mexa 300 infrared hydrocarbon analyzer with a tube placed around and about one inch from the junction between the cars' filler pipes and the nozzles' sealant means during dispensing of fuel into the cars.

TABLE III

| Sealing Means | Total Cars Filled | Percent Leaks | | |
|---|---|---|---|---|
| | | Yes | Slight | No |
| Resilient neoprene Plain Face (non-cellular) | 92 | 51.1 | 40.2 | 8.7 |
| Compressible Cellular Neoprene Face | 31 | 25.8 | 29.0 | 45.2 |

A "yes" leak was recorded if a significant amount of hydrocarbons were detected; a "slight" leak was recorded if minor amounts of hydrocarbons were detected; and a "no" leak was recorded if essentially no hydrocarbons were detected. Moreover, for a small amount of the vehicles, less than 15%, where a leak result was not recorded, correlations with other data recorded such as vapor loss and temperature, were made to classify the type of leak. The results set forth in Table III demonstrate that the nozzle of this invention shows a significant advantage in vapor recovery over a resilient neoprene sealant.

The previous examples demonstrate the outstanding recovery of hydrocarbon vapor using the improved vapor recovery apparatus of this invention. More particularly, the comparative results set forth in Examples I, II and III demonstrate the contribution of the compressible cellular plastic material in substantially preventing the escape of hydrocarbon vapor during the dispensing of fuel to a motor vehicle. The increase in percent recovery with the compressible cellular plastic material is particularly relevant where high hydrocarbon recoveries are required due to environmental regulations. In addition to providing for improved vapor recovery the compressible cellular plastic material also resists provocation of tears in the surface face as compared to a resilient material.

The improved vapor sealing means of the present invention can be employed with any liquid-dispensing nozzle. Although the system of the present invention has been disclosed with reference to a fuel delivery system, particularly a gasoline delivery system, the nozzle assembly of the present invention can be used to prevent escape of vapors in systems for the delivery of liquids other than fuels. Accordingly, it is seen that in accordance with the present invention a nozzle assembly is provided for the delivery of liquids and including means for substantially preventing escape to the atmosphere of vapor during such delivery.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A liquid dispensing nozzle assembly for delivery of liquid from a liquid source to a liquid receiver having a receiver inlet, said assembly being provided with means to allow for the removal of vapor during delivery of liquid to said receiver inlet from said source, said nozzle assembly comprising:

1. a liquid dispensing nozzle having a nozzle inlet, a nozzle housing and an elongated discharge spout adapted for insertion into said receiver inlet;
2. a vapor collector surrounding, in spaced relation thereto and forming a chamber therearound, the upper portion of said spout nearest said nozzle housing, said chamber being in fluid communication with the receiver inlet when said nozzle is inserted into said liquid receiver, one end of said vapor collector being sealed to said nozzle housing, or in proximity thereto, a sealant means carried by the other end of said vapor collector and having an exposed face for forming a surface seal against the outer surface of said receiver inlet, said spout extending beyond the other end of said sealant means; and
3. means for allowing removal of vapor from said chamber; the improvement comprising said sealant means comprising a compressible cellular plastic material, said material having:
   a. a plurality of cells present as part of its structure;
   b. compressibility under normal nozzle loads of the material in contact with the outer surface of the receiver inlet in the range of from about 5 to about 85% of that part of the material's original preload volume;
   c. substantial resistance to the liquid dispensed and vapor being removed, and
   d. the ability to form a seal against the outer surface of said receiver inlet and reduce the amount of vapor escaping to the atmosphere during liquid dispensing when said spout is inserted into and said exposed face contacts the outer surface of said receiver inlet.

2. A liquid-dispensing nozzle assembly of claim 1 wherein said compressible cellular plastic material is obtained from a polymer selected from the group consisting of polychloroprene, silicone, urethane polymer, poly (vinyl chloride), polytetrafluoroethylene, and the liquid is a fuel.

3. A liquid-dispensing nozzle assembly of claim 2 wherein the compressible cellular plastic material is obtained from a polymer selected from the group consisting of polychloroprene and polytetrafluoroethylene and the liquid is a fuel.

4. A liquid-dispensing nozzle assembly of claim 1 wherein the exposed face of the compressible cellular plastic material comprises an additional resilient material and the liquid is a fuel.

5. A liquid-dispensing nozzle assembly of claim 2 wherein the exposed face of the compressible cellular plastic material comprises an additional resilient material and the liquid is a fuel.

6. A liquid-dispensing nozzle assembly of claim 4 wherein said additional resilient material is selected from the group consisting of leather, a silicone polymer and a plastic material selected from the group consisting of polychloroprene, silicone, poly urethane, poly (vinyl chloride), polytetrafluoroethylene, and the liquid is a fuel.

7. A liquid-dispensing nozzle assembly of claim 6 wherein the compressible cellular plastic material is closed-celled and the resilient material is selected from the group consisting of leather, polychloroprene and poly (vinyl chloride), and the liquid is a fuel.

8. A liquid-dispensing nozzle assembly of claim 1 wherein said vapor collector comprises a flexible bellows and the liquid is a fuel.

9. A liquid-dispensing nozzle assembly of claim 2 wherein the vapor collector comprises a flexible bellows and the liquid is a fuel.

10. A liquid-dispensing nozzle assembly of claim 4 wherein the vapor collector comprises a flexible bellows and the liquid is a fuel.

11. A liquid-dispensing nozzle assembly of claim 7 wherein the vapor collector comprises a flexible bellows and the liquid is a fuel.

12. A liquid-dispensing nozzle assembly of claim 1 wherein said compressible cellular plastic material is closed celled, and the liquid is a fuel.

13. A liquid-dispensing nozzle assembly of claim 4 wherein said compressible cellular plastic material is closed celled, and the liquid is a fuel.

14. A liquid-dispensing nozzle assembly of claim 12 wherein said compressible cellular plastic material in contact with the outer surface of the receiver inlet is compressed under normal loads in the range of from about 25 to about 75% based upon that part of the material's original preload volume and the liquid is a fuel.

15. A liquid-dispensing nozzle assembly of claim 1 which further comprises latching means for latching said nozzle to the receiver inlet and the liquid is a fuel.

16. A liquid-dispensing nozzle assembly of claim 4 which further comprises latching means for latching said nozzle to the receiver inlet and the liquid is a fuel.

17. A liquid-dispensing nozzle assembly of claim 8 which further comprises latching means for latching said nozzle to the receiver inlet and the liquid is a fuel.

18. A liquid-dispensing nozzle assembly of claim 12 which further comprises latching means for latching said nozzle to the receiver inlet and the liquid is a fuel.

19. A liquid-dispensing nozzle assembly of claim 1 is removed by means of direct displacement to a storage tank and the liquid is a fuel.

20. A liquid-dispensing nozzle assembly of claim 18 wherein the vapor from said chambers is removed by means of direct displacement to a storage tank and the liquid is a fuel.

* * * * *

UNITED STATES PATENT OFFICE

CERTIFICATE OF CORRECTION

Patent No. 3,995,670 Dated December 7, 1976

Inventor(s) Bernard E. Weidenaar et al.

It is certified that error appears in the above-identified patent and that said Letters Patent are hereby corrected as shown below:

The term of this patent subsequent to November 23, 1993 has been disclaimed.

Signed and Sealed this

First Day of February 1977

[SEAL]

*Attest:*

RUTH C. MASON
*Attesting Officer*

C. MARSHALL DANN
*Commissioner of Patents and Trademarks*